US006250387B1

(12) United States Patent
Carmichael et al.

(10) Patent No.: US 6,250,387 B1
(45) Date of Patent: Jun. 26, 2001

(54) APPARATUS FOR CATCHING DEBRIS IN A WELL-BORE

(75) Inventors: Mark Carmichael, Aboyne; Paul Howlett, Aberdeen, both of (GB)

(73) Assignee: SPS-AFOS Group Limited, Aberdeen (GB)

( * ) Notice: Subject to any disclaimer, the term of this patent is extended or adjusted under 35 U.S.C. 154(b) by 0 days.

(21) Appl. No.: 09/235,426

(22) Filed: Jan. 22, 1999

(30) Foreign Application Priority Data

| | | |
|---|---|---|
| Mar. 25, 1998 | (GB) | 9806274 |
| Jun. 10, 1998 | (GB) | 9812456 |
| Aug. 26, 1998 | (GB) | 9818553 |
| Aug. 26, 1998 | (GB) | 9819013 |
| Oct. 3, 1998 | (GB) | 9821484 |
| Nov. 10, 1998 | (GB) | 9824528 |

(51) Int. Cl.[7] ..... E21B 23/04
(52) U.S. Cl. ..... 166/311; 166/229
(58) Field of Search ..... 166/51, 278, 227, 166/229, 234, 235, 236, 133, 131, 311

(56) References Cited

U.S. PATENT DOCUMENTS

| | | | | |
|---|---|---|---|---|
| 4,401,158 | * | 8/1983 | Spencer et al. | 166/51 |
| 4,440,218 | * | 4/1984 | Farley | 166/51 |
| 4,858,691 | * | 8/1989 | Ilfrey et al. | 166/278 |
| 5,327,960 | * | 7/1994 | Cornette et al. | 166/51 |
| 5,332,045 | * | 7/1994 | Ross et al. | 166/387 |
| 5,579,844 | * | 12/1996 | Rebardi et al. | 166/296 |

* cited by examiner

*Primary Examiner*—Christopher J. Novosad
(74) *Attorney, Agent, or Firm*—Clifford W. Browning; Woodard, Emhardt, Naughton, Moriarty & McNett

(57) ABSTRACT

A down-hole tool is described for collecting loose debris particles in a well bore. The tool has a body connectable in a work string for actively diverting well fluid through the tool body with at least some of the diverted well fluid being filtered as it passes through the tool by a filter. In a preferred embodiment the tool also comprises a cleaning member, such as a wiper for wiping the casing or liner wall of the well and a trap for trapping filtered debris up stream of the filter.

12 Claims, 8 Drawing Sheets

APPARATUS FOR CATCHING DEBRIS IN A WELL-BORE

The present invention relates to apparatus for cleaning the interior bore of well bore tubulars, such as is found in the oil and gas production industries. A distinctive aspect of the invention lies in its provision of a means for filtering or screening well fluid while down-hole.

It is considered desirable when drilling for oil or gas to maintain a clean interior in the casing or liner of the drilling well. For this purpose, well cleaning equipment is well known and comes in a variety of different forms, including casing scrapers, brushes and circulation tools. Such equipment is used to free the well tubing from debris particles such as, cement lumps, rocks, congealed mud, and so on.

Indeed well clean-up apparatus is used in an attempt to clean the casing or other well tubing of even smaller debris particles such as oxidation lumps, metal debris, scale, slivers, shavings and burrs for example.

It is now common practice to run dedicated well cleaning apparatus after cementing the liner and prior to completion. Tools have also been provided in the art which are intended to perform a cleaning operation in wellbore completions.

However, in the present invention it is recognised that during the extraction of known cleanup tools from the well, additional debris can be dislodged, such as from the wall of the casing, thereby negating much of the cleaning work already performed. In fact, the dislodgement of debris or particles during the extraction of the tool can render futile the processes of filtering and fine-screening that may have gone before. This problem is particularly prevalent as such cleanup tools, known to the art, typically have their cleaning members biased outwardly to ensure adequate pressure of the cleaning members on the walls of the casing or liner. While this is of assistance during the cleaning process, it has been a disadvantage during the extraction of the tool from the well.

It is also recognised in the present invention that tools suited to the cleaning of well tubulars are not generally also equipped to clean the well fluid. It is usual therefore that debris dislodged from the casing or liner walls is not then fully removed from the well by circulation. Rather, the debris may remain suspended in well fluid down-hole, having detrimental effects during subsequent production stages.

An object of the present invention is to obviate or at least mitigate this problem associated with known clean up tools and their use.

A further object of the present invention is to provide apparatus suitable for providing a means of trapping and collecting debris in a well-bore.

In the art there are tools commonly referred to as junk catchers. These tools are of varying design; some being suitable for running on a pipe string, other on coiled tubing, and yet others on wireline. A notable aspect of such tools, however, is that while they invariably provide a cage or some other catchment area for collecting debris or the like down-hole, they are not adapted to filter properly the well fluid. More particularly, junk catchers and or junk subs known in the art have not been arranged to encourage the circulation of well fluid through a filter in a manner that is pro-actively designed to screen debris or other particles out of the fluid.

According to the present invention there is provided a down-hole tool for collecting loose debris particles in a well bore, the tool comprising a body connectable in a work string, diversion means for diverting well fluid passing the tool through the tool body, and a filtration means for filtering debris particles from at least some of the well fluid.

The work string may be a pipe string, coiled tubing or a wireline.

It should be understood that the diversion means may be formed wholly or partially integral with the tool body. Preferably the diversion means comprises a barrier having an outer diameter that corresponds with the internal diameter of an adjacent tubular in the well bore to the extent that there is negligible fluid by-pass outside the tool body, and one or more flow paths that direct fluid passing through the tool body to the filtration means. It is possible to design the tool such that it filters the well fluid when the fluid moves in only one direction relative to the tool, that is in either an up-hole direction or a down-hole direction. This may be achieved by providing a plurality of flow paths in the tool body, the flow paths being associated with respective one-way valves whereby when the fluid passes through the tool body in a first relative direction it does so through a first set of the flow paths having one way valves that so permit, and when the fluid passes through the tool body in a second and opposite relative direction it does so through a second set of the flow paths having one way valves that so permit, but wherein only one of the first and second set of flow paths is adapted to divert the fluid through the filtration means.

The valve means may be balls moveable within respective flow paths under the influence of fluid flow or pressure, wherein the balls are sized to land in sealing engagement with a restricted area in the flow paths for blocking further passage of fluid in a particular direction in the respective flow path.

The barrier is preferably formed as a separate component from the tool body. One advantage of this is that the barrier may be connectable to the body by bearings, thereby permitting relative rotation between the tool body and the barrier. Accordingly the barrier need not rotate against the well bore tubular, enabling improved longevity through less wear. Additionally, the barrier may be replaced, if necessary, without the requirement of replacing the entire tool body.

It may be appreciated that these advantages are most applicable where the barrier contacts the well bore tubular. Preferably, the barrier is a resilient member which is radially compressed by the well bore tubular in use and which is adapted to wipe the well bore tubular as the tool moves up or down the well bore.

There may be more than one barrier, and in a preferred embodiment, a barrier in the form of a resilient wiping member may be provided toward each end of the tool.

Where the tool is adapted for connection to a pipe string or coiled tubing, the tool body is preferably provided with an internal bore adapted to communicate with a circulation path in the work string.

The filtration means may be a wire screen sized to prevent particles of a predetermined size from passing therethrough. It will be appreciated however that many different types of filtration apparatus may be used, including permeable textiles, holed tubes or cages, and so on. The filtration means need not be limited to any one particular type of screen or filter, but may rather comprise of a plurality of filters in series; the filters being potentially of varying type and permeability.

The tool may also act as a collector or trap for debris and the like. For example, a trap may be provided on the up-stream side of the filter means for storing the filtered debris.

Optionally, a separate filter may be provided for each filtered flow path, and the flow paths on the up-stream side of the filter means may act as the traps for collecting the debris particles.

Preferably the tool comprises an emergency by-pass means, whereby well fluid is enabled to by-pass the filter means, for example when the filter becomes blocked or clogged. The emergency by-pass means may comprise of means for displacing the barrier relative to the tool body to a position where it no longer diverts substantially all of the fluid passing the tool through the tool body. Alternatively, the tool body may include radial outlets communicating with the one or more flow paths, the outlets being maintained in a closed state by an obturating member in normal use, but being openable by movement of the obturating member to create the emergency bypass flow path. Typically, the obturating member may be held in an obturating position by one or more shear pins, wherein said shear pins are adapted to shear or otherwise fail under a given load, resulting from an increase in pressure due to blockage of the filter means.

The tool requires the relative movement of the well fluid in order to perform its function as a filter. This may be achieved by the movement of the tool in a down-hole or an up-hole direction or by circulating fluid in the well bore such that it has a net movement relative to the tool, regardless of whether the tool is being moved or held stationary.

Also according to the invention there is provided a method of cleaning a down-hole environment comprising the steps of:

a) running a tool heading a filtration means on a work string down-hole;

b) creating relative movement between the down-hole movement and the tool; and c) actively guiding at least some of the fluid passing the tool through the filtration means.

Preferably, the method further includes the process of tapping filtered debris upstream of the filtration means.

In order to provide a better understanding of the invention, embodiments thereof will now be described, by way of example only, and with reference to the accompanying drawings, in which.

Figure 3:
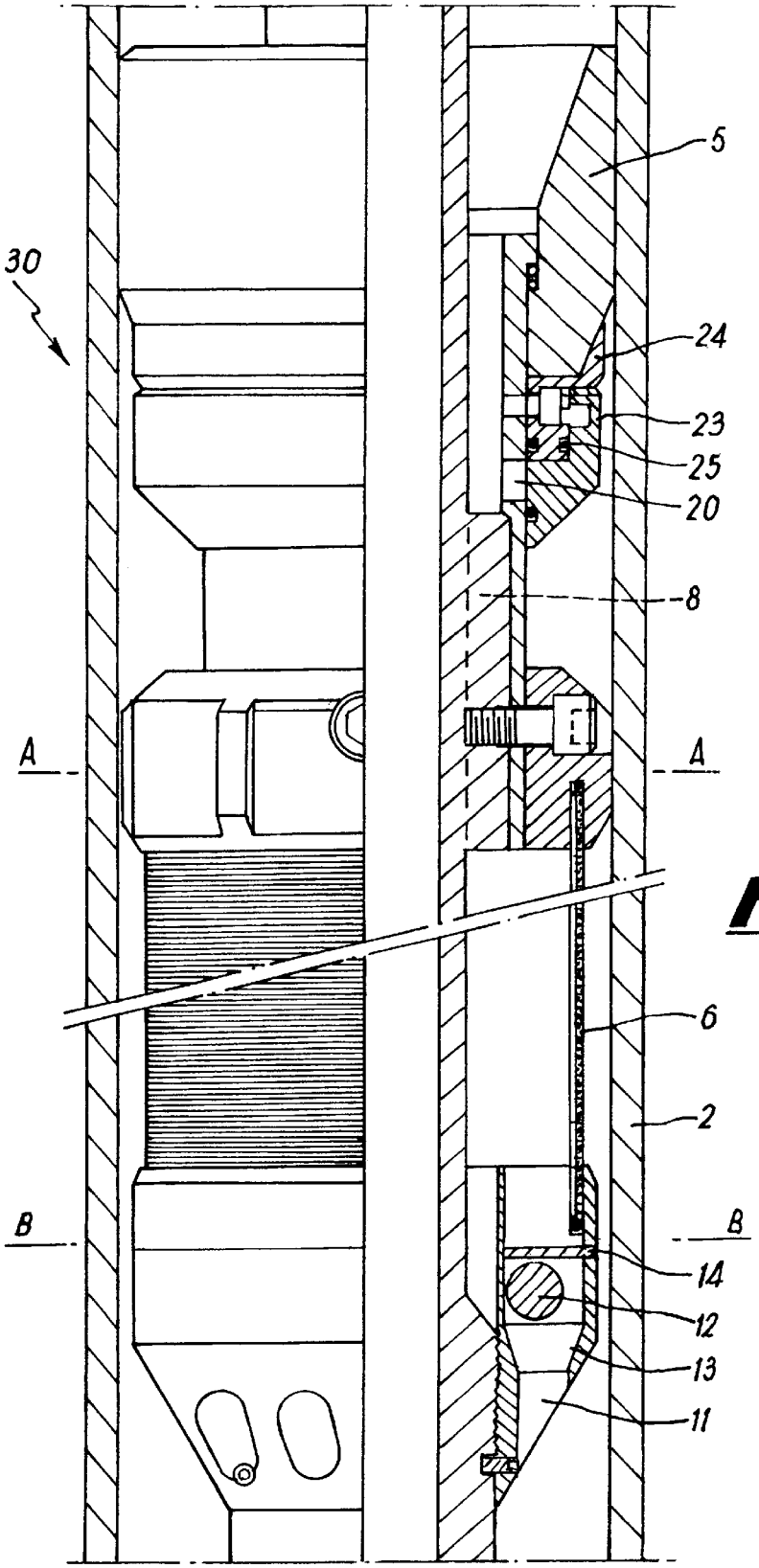
FIG. 3 is a half sectional elevation of a tool incorporating the improvement of FIG. 2.
Figure 4A:
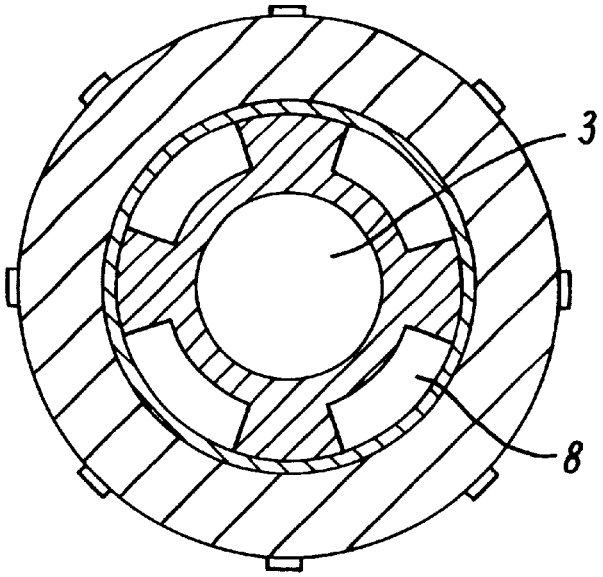
Figure 4B:
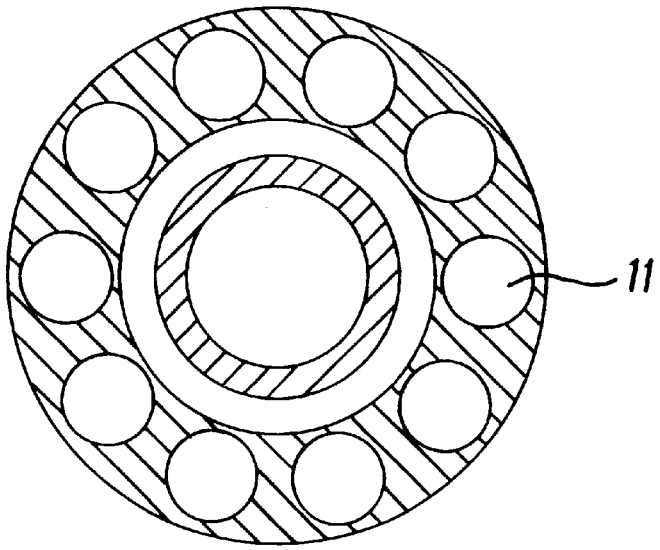
Figure 5:
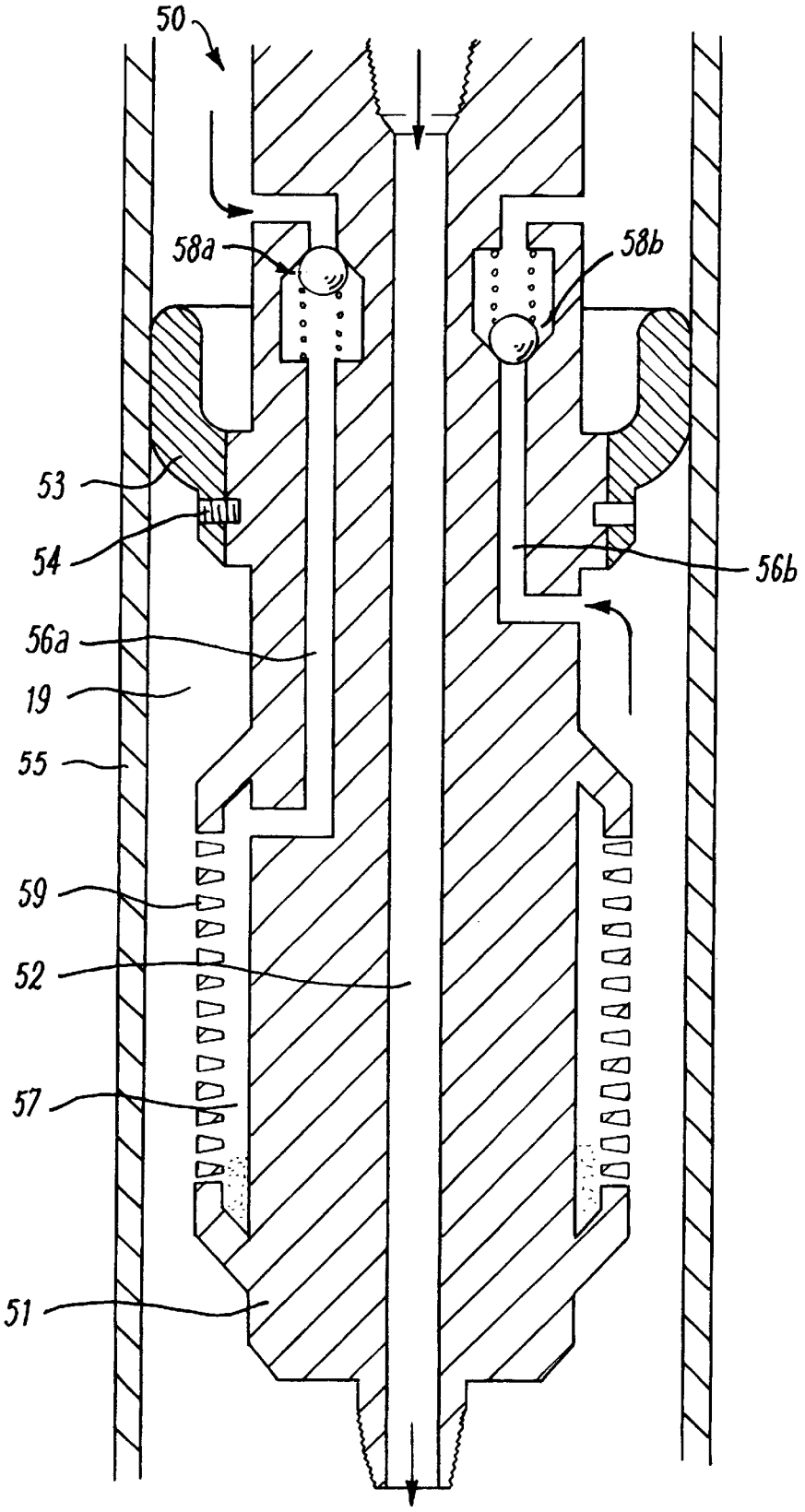
Figure 6:
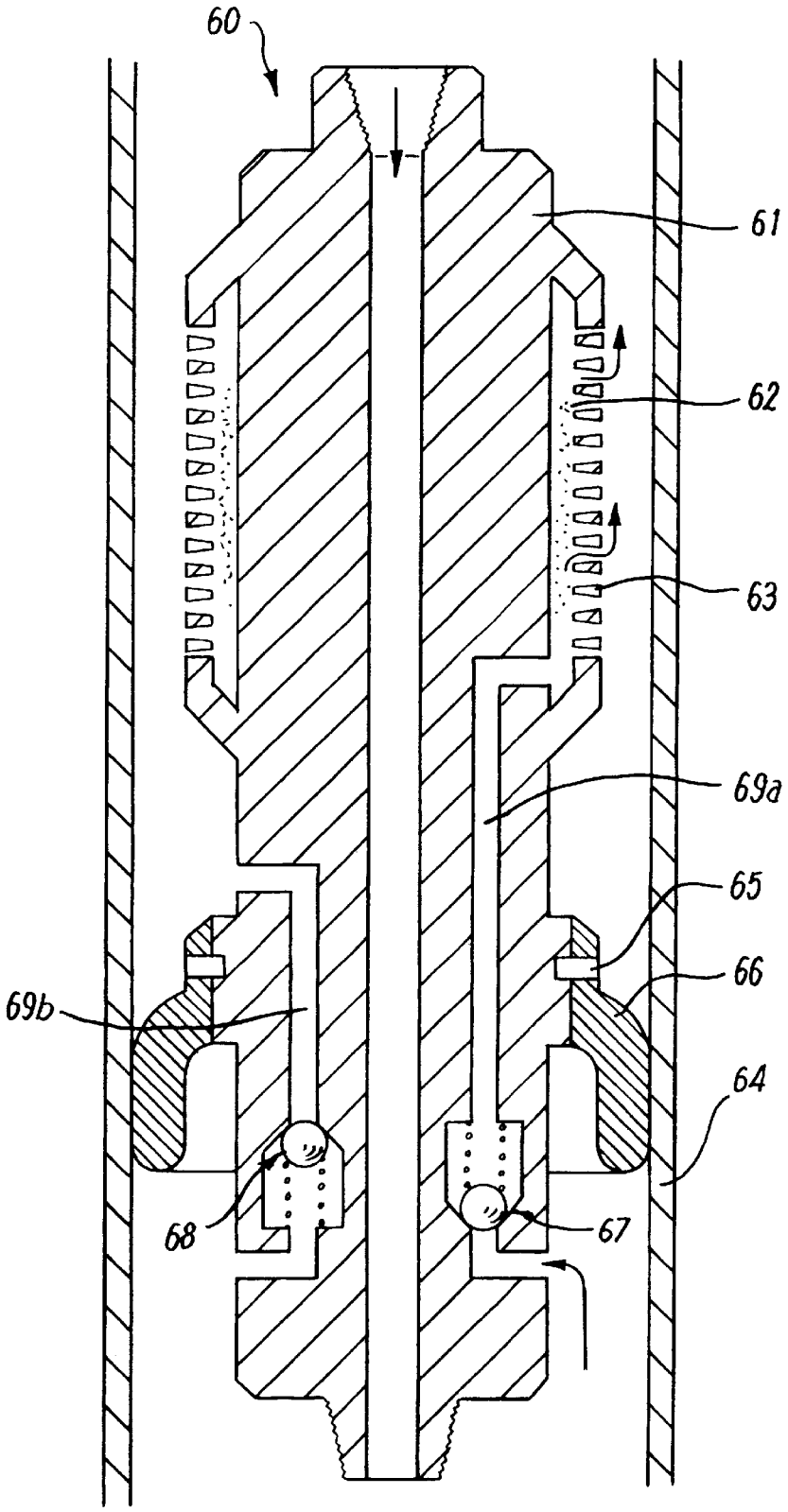
Figure 7:
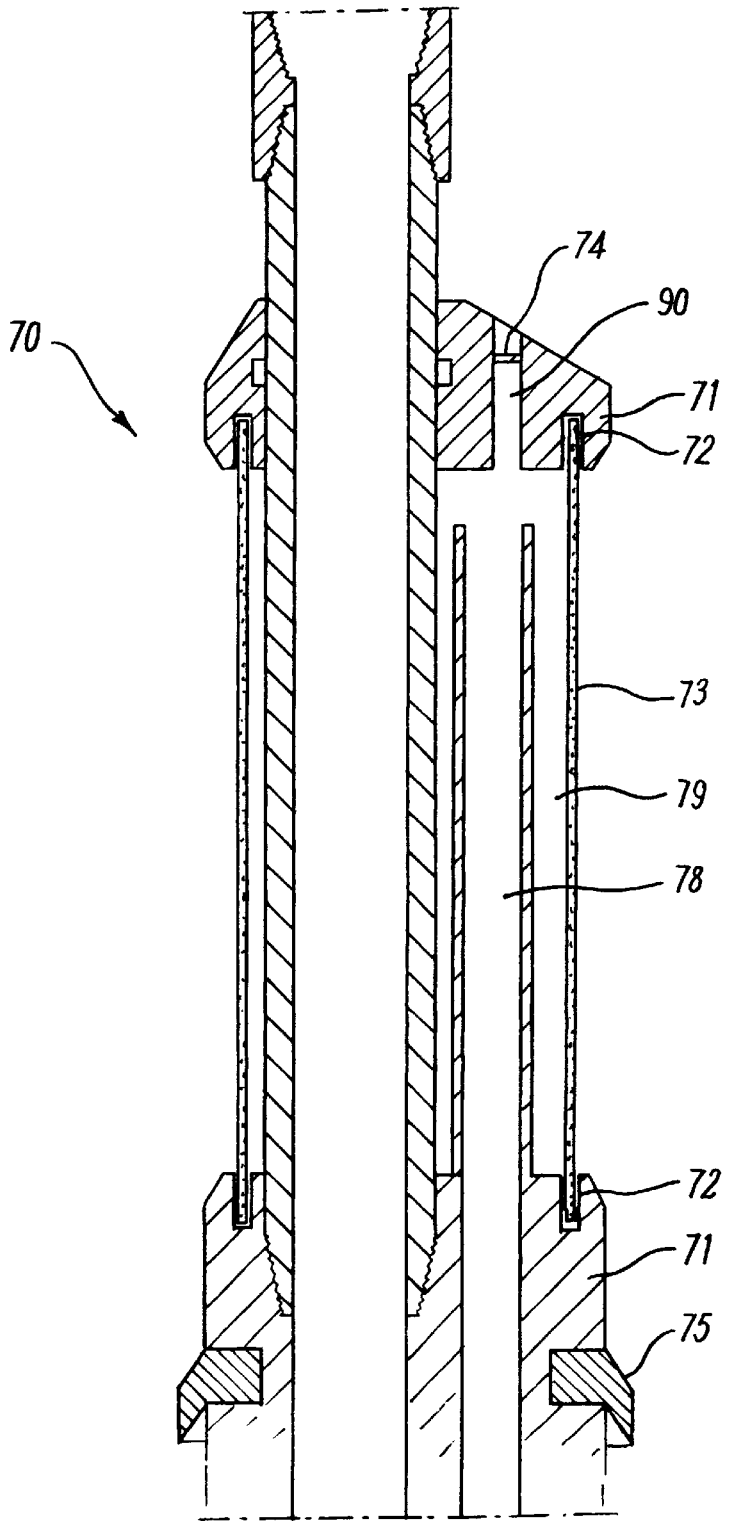
Figure 8:
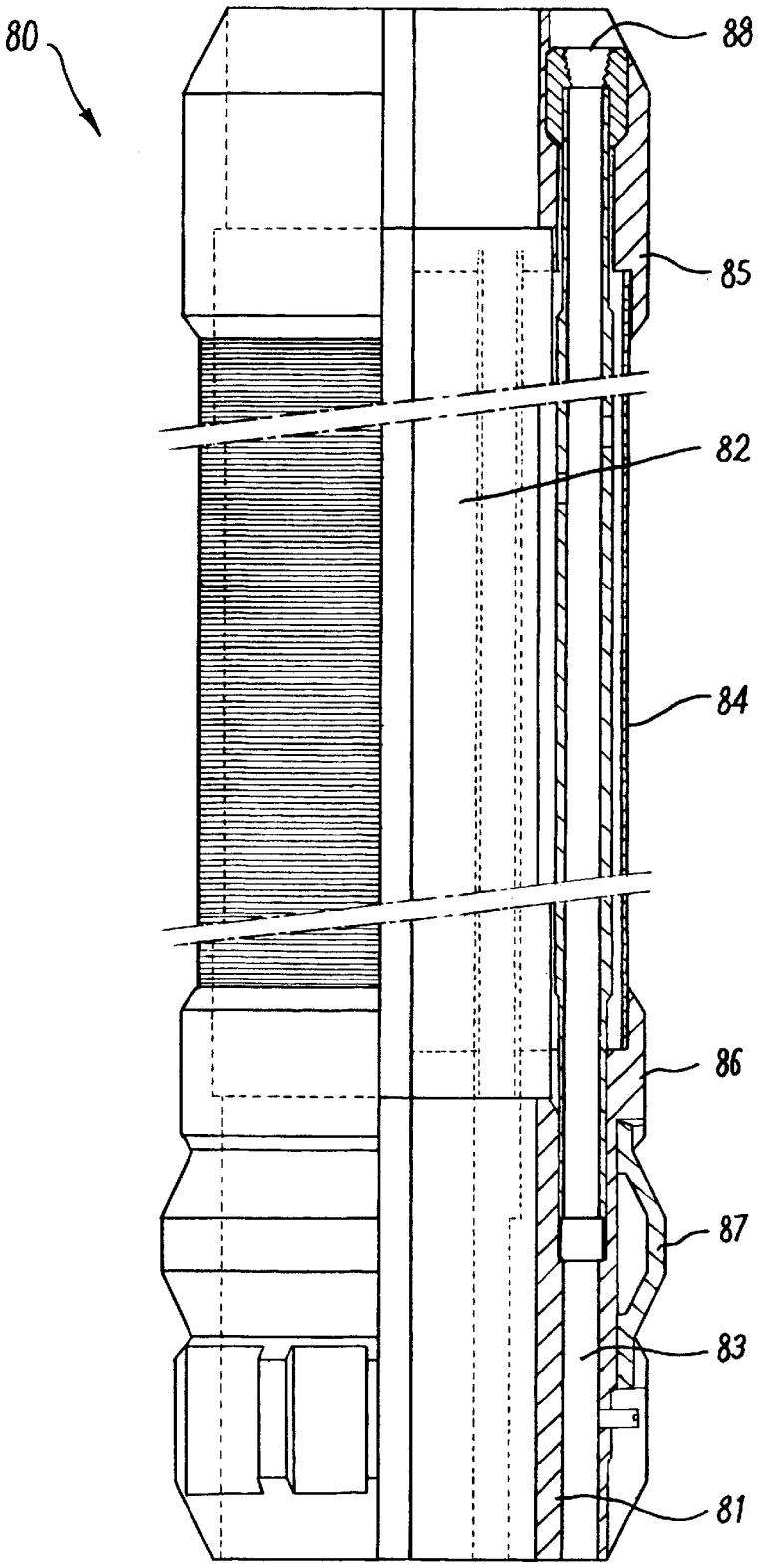

FIGS. 4*a* and 4*b* are cross sections through the lines A—A and B—B respectively of the tool of FIG. 3;

FIG. 5 is a full sectional elevation of an alternative embodiment of tool;

FIG. 6 illustrates, again in sectional elevation, a tool of similar design to that depicted in FIG. 5, but with an arrangement suited to filtering the well fluid on running in the well; and FIGS. 7 and 8 also show sectional elevations of two further embodiments of tools in accordance with the invention, and both being suitable for use when putting in to a well-bore such as during well completion.

Figure 1:
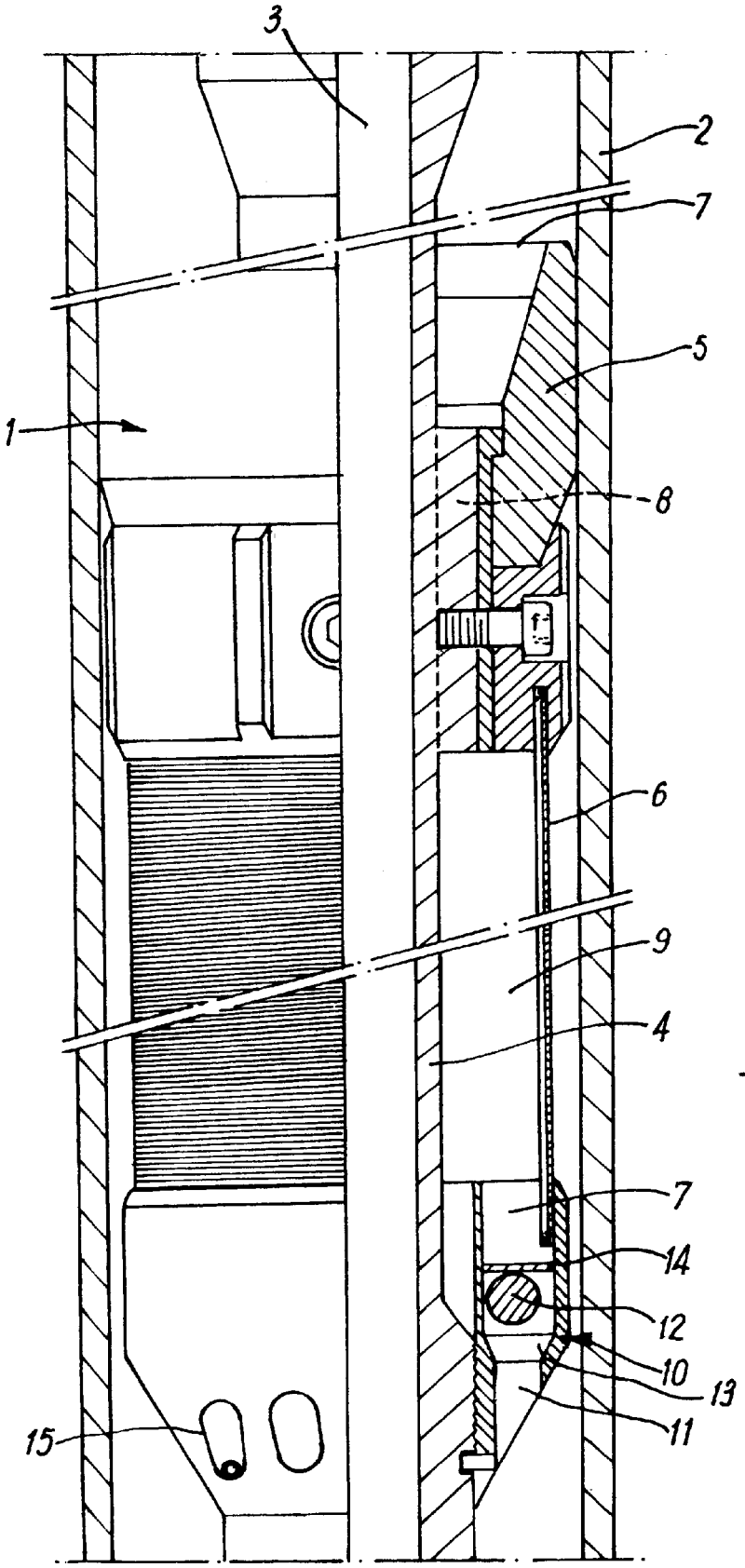
FIG. 1 is a half sectional elevation of a first embodiment of a tool in accordance with the invention.

In FIG. 1 there is depicted a tool 1 located in a well bore tubular 2, such as a casing. The tool 1 is intended to be run on a pipe string and is provided with an internal bore 3 defined by the internal diameter of a central mandrel 4 running the full length of the tool 1. The bore 3 offers a circulation path for well fluid flowing up or down the pipe string.

The tool body is provided by the central mandrel 4 and further components built up around the mandrel 4. These components provide a housing or attachment means for a barrier 5 and a filter 6.

Flow paths on the outer side of the mandrel 4 for well fluid are defined by the tool body, barrier 5 and filter 6. It should be noted however that the flow paths of well fluid differ depending on which direction the fluid travels relative to the tool 1.

The tool 1 is designed to filter the well fluid when the well fluid on the outer side of the mandrel 4 moves (relative to the tool 1) in a down-hole direction. This will occur when fluid is pumped down the annulus between the pipe string and the casing 2, but more typically when the tool 1 is pulled out of the hole.

As this occurs, the well fluid travels through one or more flow paths defined by the inlet 7 in the barrier 5, a plurality of bores 8 provided in an enlarged area of the mandrel 4, an annular chamber 9, through the filter 6 and finally past the outer circumference of a lower retaining assembly 10.

Thus, it may be perceived that well fluid passing the tool in this direction will be filtered by the filter 6. Notably, the fluid can not pass through channels 11 formed in the lower retaining assembly 10 in a down-hole direction by reason of a one-way valve located in each said channel 11.

In this example embodiment, each valve comprises of a ball 12 that co-operates with a restricted area or landing 13 in the channels 11. Fluid flowing in a relative down-hole direction forces the balls 12 down on to their respective landing 13, the balls and landings being sized to allow for their sealing engagement.

Each ball 12 is moveable in its respective flow channel 11 under the influence of fluid flow or pressure. However, upward or up-hole movement of the balls 12 is limited by a bar 14 provided in each channel 11. The bars 14 prevent further upward movement of the balls 12 but do not restrict the flow of fluid through the channels 11 even when the balls 12 are pressed up against them.

The valve means need not be provided as balls and rests. The invention envisages the use of a one way valve system and forms of such are plentiful and will be well known to those skilled in the art. Where moveable balls are used, it would be preferable to provide them with relatively low specific gravity to ensure that they are suitably influenced by fluid flow.

Thus, when the fluid travels in an up-hole direction relative to the tool 1, such as during normal circulation or when the tool is run in the well bore, the one or more flow paths of the fluid are defined by the channels 11 commencing at their inlets 15, the chamber 9, bores 8 and finally out the opening 7 in the barrier 5. This relatively unrestricted flow path provides little hindrance to the running of the tool, having ample bypass area and not requiring the fluid to pass through the filter 6.

In the example tool depicted in FIG. 1, the barrier 5 comprises a resilient swab cup, with a concave-up orientation. The outer circumference of the cup 5 wipes the casing 2 as the tool 1 moves in the well bore. The cup is designed to access remote or uneven locations in the casing 2, such as joints in the casing string or other areas where cavities on irregular dimensioning may occur. The cup 5 is particularly suitable for wiping any grease or other debris particles off the casing and into suspension in the well fluid, thereby enabling it to be filtered by the tool, especially when the tool 1 is pulled out of the hole.

The profile of the cup 5 also serves as a diversion means by diverting well fluid travelling in a relative down-hole direction into the opening 7 and down through the one or more flow paths.

The barrier 5 need not be keyed to the tool body allowing it have minimal rotational movement even when the work string is rotated. In the tool 1, the cup 5 is mounted on bearings 16 for this reason, which allows for its reduced wear and longer life.

The filter 6 is shown as a wire wrap filter, although gauze or any other suitable filtration medium known to persons skilled in the art may be employed. The chamber 9 acts as a trap in which the filtered debris may collect.

An improvement over the novel tool discussed above lies in the provision of an emergency bypass. This may be required for example when a tool is required to clean a particularly dirty well and there is a build up of debris in the tool to such extent that insufficient flow can pass through the filter means. In such event it would be advantageous to provide a means for allowing fluid to bypass at least the filter and associated debris trap when the tool is being pulled out of the hole or during circulation.

One manner of achieving this emergency by-pass in relation to a tool of similar design to that depicted in FIG. 1 involves the displacement of the barrier means to a position relative to the tool where fluid may by-pass around the outside of the barrier means. An embodiment incorporating this facility is discussed with reference to FIG. 5. Another option is to provide a rupture disc or the like in the barrier means which opens when subjected to a predetermined pressure.

Figure 2:
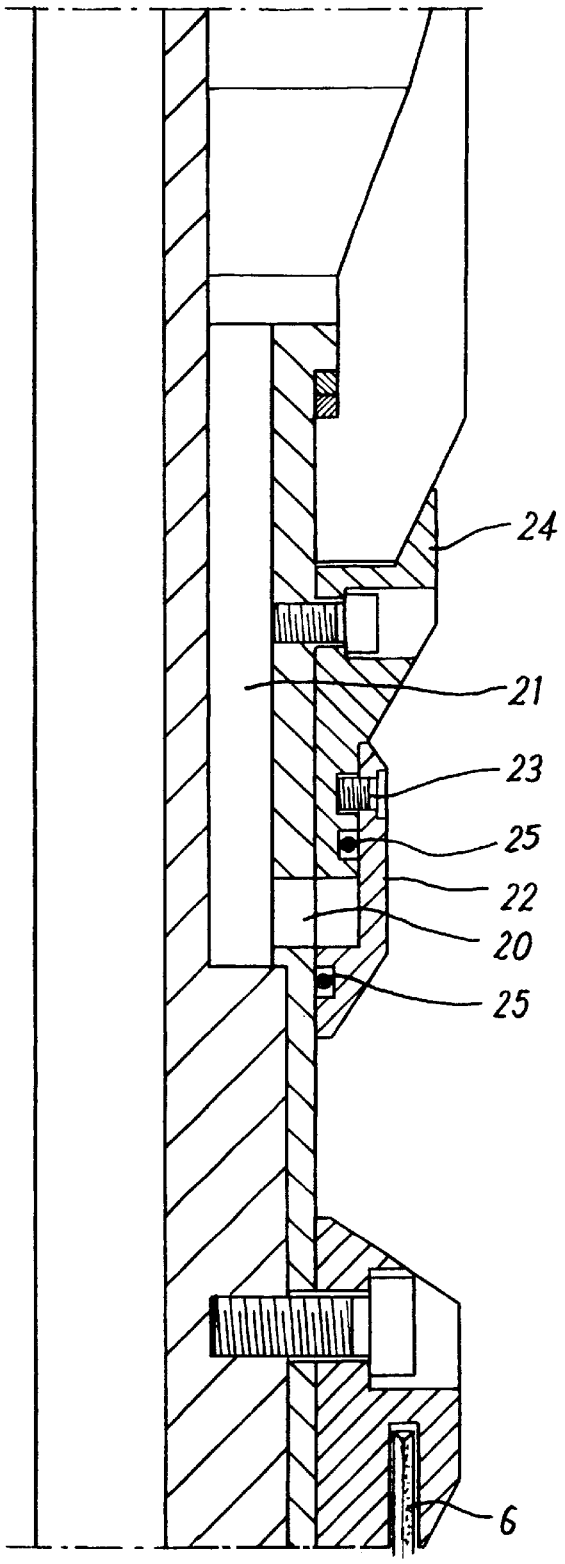
FIG. 2 is a half sectional elevation of a portion of a tool similar to the tool of FIG. 1, but incorporating a further improvement.

A further option is shown in the example embodiment illustrated in FIG. 2, wherein a radial outlet 20 communicates with a flow path 21. In normal use the outlet 20 is closed by an obturating sleeve 22 held in place by a screw or other mechanical fastener 23 that connects with the barrier retaining assembly 24. Seals 25 maintain the integrity of the closed outlet 20. However in the event that there is a build up of pressure in the flow path 21 resulting from a blockage or the like, the mechanical fastener 23 breaks allowing for the giving way of the obturating sleeve 22 and the passage of fluid out of the outlet 20, thereby by-passing the filter 6 and blockage further down in the tool.

FIGS. 3 and 4 show, in sectional elevation and cross section respectively, a tool 30 incorporating the improvement discussed above with reference to FIG. 2. Like parts in the afore-described tools are given identical reference numbers for ease of comparison of the Figures.

The tool 30 would suitably be located at or near the bottom of a work string to ensure that it was positioned to catch all or at least the majority of debris or particles that might be dislodged from the casing during the extraction of the work string. However, it is envisaged in the invention that a tool incorporating the invention may be run in conjunction with other tools or subs so as to provide a synergy. For example, a tool in accordance with the present invention may be run with a junk catcher or the like located below it on a work string. A further example would be to run a tool incorporating the invention with other well clean-up tools such as casing scrapers, brush tools and the like known to the art from time to time. Similarly, a ball-drop sub may be run in a work string above a tool described herein to allow for communication of fluid between the work string and the annulus between the work string and the well bore tubular.

Turning now to FIG. 5, a further embodiment of a tool adapted to filter well fluid while down-hole is depicted. The tool 50 has a body 51 defining an axial circulation path 52 internally therein. The tool 50 is attachable in a work string through the provision of threaded connectors at its respective axial ends.

Attached to the periphery of the body 51 is a resilient cup 53 positioned in a concave up orientation. The cup 53 sealingly engages the internal surface of the casing wall 55, wiping the casing as the tool 50 moves. the cup 53 further provides a barrier which diverts fluid passing the tool 50 into the flow paths 56 formed in the walls of the body 51. The flow paths 56 provide a passage for the flow of fluid past and generally outside the tool 20, creating a by-pass around the cup 23.

The flow path 56*a* allows well fluid to travel in a rdown-hole direction relative to the tool 50. Positioned in the flow path 56*a* is a check valve 58*a* having a ball that is biased against a seat or restricted area to close the valve. However when the tool 50 is being retrieved or picked up, fluid pressure acts on the upper surface of the ball so as to open the valve 58*a* and allow for the passage of fluid through the flow path 56*a* to the chamber 57. The chamber 57 provides a trap or collection reservoir for debris or other particles that are unable to pass through a filter 59 provided at the outlet of the passage 56*a*.

A second flow path or set of flow paths 56*b* is also formed in the body 51. These provide a path for the passage of fluid past the tool 50 in a relative up-hole direction. The flow path 56*b* is also provided with a check valve 58*b*, but one which is adapted to open in response to upward fluid pressure, such as would be expected when the tool is run in a down-hole direction in the well bore. The ball in the valve 58*b* may rest on its seat under gravity or be biased downward by a spring or the like.

The embodiment of the tool 50 incorporates an emergency by-pass means to cater for a situation where one or more of the check valves become jammed or clogged in a closed position or the flow paths become other wise blocked, such as in the chamber 57 in the flow path 56*a*. This is so because, if necessary, fluid may be pumped up past the cup barrier 53, given the resilient properties of the cup walls. Moreover, fluid may be pumped down hole relative to the tool so as to pressure up above the cup 53 until the shear screw 54 shears and allows the cup to move down relative to the body 51 until it rests in the inset 19.

The above described tools may also be provided with a barrier or other wiping means at the lower end of the tools. This may be advantageous when the tool is run into the well as it, rather than the barrier at the top of the tool would push the majority of the grease and other debris, preventing a build up of such debris around the outside of the tool that may serve to at least partially clog the outside of the filter. A wiping or other cleaning means located at or toward the lower end of the tool would cause the resultant dislodged debris to be suspended in the well fluid and then flow back up the on or more flow paths in the tool, enabling it to be readily filtered as the tool is pulled out.

Although the example embodiments described above have been intended for running on pipe string, tools incorporating the invention may be readily designed to enable their use on coiled tubing or wireline. As the tools thus far described filter the well fluid on pulling out of the well and not when running in the well there is typically less resistance to movement of the tool in a down-hole direction than in the up-hole direction. It becomes feasible therefore to cater for operations on coiled tubing or wireline where, particularly with the latter, the ability to "push" the tool is limited.

It would be advantageous in respect of wireline operations, for example, to associate a charging means with a resilient barrier, whereby when the tool is run in the well the barrier is not charged and there is negligible or no contact of the barrier with the well bore tubular, but when the tool is pulled out of the well the barrier is charged by the pressure of the fluid on the up-hole side of the barrier so that the barrier forcibly acts against the tubular and performs a desired wiping function.

As indicated above, the present invention also finds application in well completions. For example the embodiments illustrated in FIGS. 6 to 8 herein serve to trap debris as the tools are lowered into the well.

The tool 50 comprises a body 51 having at least 2 by-pass flow paths 59 formed partially therein. The flow paths incorporate valves 57 and 58 for controlling the direction of flow through the body 51.

Flow path 69*a* is adapted to allow the flow of well fluid in a relative upward direction and communicates with a filter means 63. Flow path 69*b* allows for fluid to flow through the body 61 in a relative downward direction. Thus, as the tool 60 is lowered into a well, undesirable debris is collected in the debris chamber 62. When and if the tool 60 is retracted from the well, fluid may pass through the tool 60 via the flow path 69*b*.

The tool 60 also includes a cup seal 66 that engages the casing wall 64. The cup 66 while acting to divert the flow of well fluid through the paths 69, may also be used as a means for wiping the casing wall. Alternatively, scraper blades may be mounted on the outer surface of the cup 66, and the cup may scrape (rather than wipe) the casing. The cup 66 is attached to the body 61 by a shear pin 65 that fails in the event, for example, that passage of fluid through the path 69*a* becomes obstructed sufficiently to cause a predetermined build up of pressure under the cup 66.

Turning now to FIG. 7, a yet further embodiment of a tool 70 is illustrated. The tool 70 incorporates detachable retaining members 71 that are formed with an annular recess 72 in which is located a cylindrical filter 73. In the upper retaining means 71 there is provided a rupture disc 74 that again is designed to fail under a predetermined load, thereby providing an emergency bypass flow path which avoids the need for fluid passing the tool to pass through the filter 73.

In the lower retaining means 71 a barrier 75 is provided for the purpose of reducing or negating fluid by-pass between the exterior of the tool 70 and the casing or liner wall (not shown).

In the example embodiment illustrated the retaining means 71 are attached to the mandrel of the tool body via bearings. This allows relative rotation between the mandrel and the retaining means 71 having the effect of mitigating wear of the wiper 75 or casing wall.

In use, as the tool 70 is lowered into the well, fluid flows up the path 78 and any debris in the fluid collects in the chamber 79. If the filter 73 becomes too blocked the rupture disc 74 opens the emergency by-pass flow path 90. The tool 70 may be kept down-hole during completion. However, if and when it is sought to retract the tool 70 from the well it is possible to first pressure up above the rupture disc 74 again to open flow path 90 (which communicates with path 78), thereby creating a by-pass flow path enabling the safe retraction of the tool.

A final and preferred example embodiment for use in filtering well fluid, particularly in well bore completions, is illustrated in FIG. 8.

The tool, generally referenced 80, has a body 81 defining a central bore 82 and one or more flow paths 83. A screen 84 for filtering well fluid is held by upper 85 and lower 86 retaining assemblies. The lower filter retaining assembly 86 also functions as an upper retaining assembly in relation to a barrier 87, that wipes the well tubular upon movement of the tool 80 and prevents bypass of fluid outside of the tool 80 at that point.

In likeness to the embodiment of FIG. 7 a rupture disc 88 is formed in the upper filter retaining assembly 85 to enable emergency bypass when the screen 84 becomes blocked.

While well cleanup applications have been described by way of example, it should be understood that the present invention is not limited to such tools or such applications. For example, the invention could be applied to pipeline pigs.

Further modifications and improvements may be incorporated without departing from the scope of the invention herein intended.

What is claimed is:

1. A down-hole tool for collecting debris particles in a well bore, the tool comprising, a body connectable in a work string, diversion means for diverting through the tool body well fluid passing the tool, and a filtration means for filtering debris particles from at least some of the well fluid.

2. The tool as claimed in claim 1 comprising a barrier dimensioned relative to a casing or liner in the well bore in a manner that permits negligible by-pass of fluid outside the tool body.

3. The tool as claimed in claim 2 wherein the diversion means comprises the barrier and one or more flow paths that direct fluid passing through the tool body to the filtration means.

4. The tool as claimed in claim 1 further comprising an emergency by-pass that is obstructed in normal use of the tool but opens upon the occurrence of predetermined conditions, wherein the emergency by-pass enables fluid flowing past the tool to by-pass the filtration means.

5. The tool as claimed in claim 4 comprising a barrier dimensioned relative to a casing or liner in the well bore in a manner that permits negligible by-pass of fluid outside the tool body, wherein the emergency by-pass is caused by the displacement of the barrier relative to the tool body to a position where it no longer diverts substantially all of the fluid passing the tool through the tool body.

6. The tool as claimed in claim 4 wherein the tool body has radial outlets communicating with one or more flow paths, the outlets being maintained in a closed state by an obstructing member in normal use, but being openable by movement of the obstructing member to create the emergency by-pass.

7. The tool as claimed in claim 4 comprising a barrier dimensioned relative to casing or other tubulars in the well bore in a manner that permits substantially no by-pass of fluid outside the tool body, wherein the emergency by-pass is created by the rupture of a member in the barrier.

8. A down-hole tool comprising means for wiping well casing or other tubulars, a trap for collecting debris or other matter and a filter for filtering well fluid while the tool is down-hole.

9. A down-hole tool comprising a body connectable in a work string and a filter for filtering well fluid passing the tool while down-hole, wherein the body defines a circulation path communicating with a circulation path in the work string for enabling circulation of fluid through the tool.

10. The down-hole tool as claimed in claim 9 wherein the tool body defines one or more flow paths for providing passage of fluid between the work string and the well bore casing or other tubular, wherein at least some of the flow paths are associated with respective filtration means for filtering fluid as it passes the tool.

11. A method of cleaning a down-hole environment comprising the steps of:

a) running a tool heading a filtration means on a work string down-hole;

b) creating relative movement between the down-hole movement and the tool; and c) actively guiding at least some of the fluid passing the tool through the filtration means.

12. The method as claimed in claim 11 further including the process of trapping filtered debris upstream of the filtration means.

* * * * *

US006250387C1

(12) EX PARTE REEXAMINATION CERTIFICATE (5593rd)

United States Patent
Carmichael et al.

(10) Number: US 6,250,387 C1
(45) Certificate Issued: Oct. 31, 2006

(54) APPARATUS FOR CATCHING DEBRIS IN A WELL-BORE

(75) Inventors: Mark Carmichael, Aboyne (GB); Paul Howlett, Aberdeen (GB)

(73) Assignee: SPS-AFOS Group Limited, Aberdeen (GB)

Reexamination Request:
No. 90/006,281, May 6, 2002

Reexamination Certificate for:

| | |
|---|---|
| Patent No.: | **6,250,387** |
| Issued: | **Jun. 26, 2001** |
| Appl. No.: | **09/235,426** |
| Filed: | **Jan. 22, 1999** |

(30) Foreign Application Priority Data

| | | |
|---|---|---|
| Mar. 25, 1998 | (GB) | 9806274 |
| Jun. 10, 1998 | (GB) | 9812456 |
| Aug. 26, 1998 | (GB) | 9818553 |
| Aug. 26, 1998 | (GB) | 9819013 |
| Oct. 3, 1998 | (GB) | 9821484 |
| Nov. 10, 1998 | (GB) | 9824528 |

(51) Int. Cl.
*E21B 23/04* (2006.01)

(52) U.S. Cl. ..... 166/311; 166/229
(58) Field of Classification Search ..... 166/311, 166/229
See application file for complete search history.

(56) References Cited

U.S. PATENT DOCUMENTS

| | | | | |
|---|---|---|---|---|
| 3,123,157 A | | 3/1964 | Graham | |
| 3,316,971 A | | 5/1967 | Brown | |
| 3,814,180 A | | 6/1974 | Oliver | |
| 4,401,158 A | * | 8/1983 | Spencer et al. | 166/51 |
| 4,440,218 A | * | 4/1984 | Farley | 166/51 |
| 4,515,212 A | | 5/1985 | Krugh | |
| 4,858,691 A | * | 8/1989 | Ilfrey et al. | 166/278 |
| 5,327,960 A | * | 7/1994 | Cornette et al. | 166/51 |
| 5,330,003 A | | 7/1994 | Bullick | |
| 5,332,045 A | | 7/1994 | Ross et al. | |
| 5,579,844 A | * | 12/1996 | Rebardi et al. | 166/296 |
| 6,176,311 B1 | | 1/2001 | Ryan | |

FOREIGN PATENT DOCUMENTS

| | | |
|---|---|---|
| GB | 2295838 B | 7/1998 |
| NO | 300234 | 4/1997 |

* cited by examiner

*Primary Examiner*—William Neuder

(57) ABSTRACT

A down-hole tool is described for collecting loose debris particles in a well bore. The tool has a body connectable in a work string for actively diverting well fluid through the tool body with at least some of the diverted well fluid being filtered as it passes through the tool by a filter. In a preferred embodiment the tool also comprises a cleaning member, such as a wiper for wiping the casing or liner wall of the well and a trap for trapping filtered debris up stream of the filter.

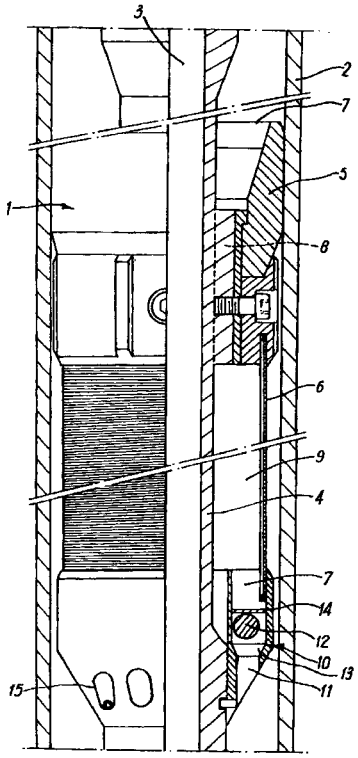

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 8–12 are cancelled.

Claims 2–5 and 7 are determined to be patentable as amended.

Claim 6, dependent on an amended claim, is determined to be patentable.

New claims 13–20 and 21 are added and determined to be patentable.

2. The tool as claimed in claim [1] *21* comprising a barrier dimensioned relative to a casing or liner in the well bore in a manner that permits negligible by-pass of fluid outside the tool [body].

3. The tool as claimed in claim 2 wherein the diversion means comprises the barrier and one or more flow paths that direct fluid passing through the tool [body] to the [filtration means] *filter*.

4. The tool as claimed in claim [1] *21* further comprising an emergency by-pass that is obstructed in normal use of the tool but opens upon the occurrence of predetermined conditions, wherein the emergency by-pass enables fluid flowing past the tool to by-pass *some of* the [filtration] *diversion* means.

5. The tool as claimed in claim 4 comprising a barrier dimensioned relative to a casing or liner in the well bore in a manner that permits negligible by-pass of fluid outside the tool body, wherein the emergency by-pass is caused by the displacement of the barrier relative to the [tool] body to a position where it no longer diverts substantially all of the fluid passing the tool through the tool [body].

7. The tool as claimed in claim 4 comprising a barrier dimensioned relative to casing or other tubulars in the well bore in a manner that permits [substantially no] *negligible* by-pass of fluid outside the tool [body], wherein the emergency by-pass is created by the rupture of a member in the barrier.

*13. The tool as claimed in claim 21 wherein the fluid flow is in a relative upward direction in the first direction and a relative downward direction in the reverse direction.*

*14. The tool as claimed in claim 21 wherein the fluid flow is in a relative downward direction in the first direction and a relative upward direction in the reverse direction.*

*15. A tool as claimed in claim 21 comprising means for wiping well casing or other tubulars.*

*16. A tool as claimed in claim 21 comprising a trap for collecting debris or other matter.*

*17. A method of cleaning a down-hole environment while running a tool on a work string, the tool having an internal bore axially there-through for the circulation of fluid through the work string and a dedicated filter for filtering debris particles from well fluid, comprising the steps of:*

*(a) creating relative movement in a first direction between the down-hole fluid and the tool while actively guiding at least some of the fluid passing the tool through the tool in a relatively unrestricted flow path distinct from the internal bore, so as to by-pass the dedicated filter; and*

*(b) creating relative movement in a reverse direction between the down-hole fluid and the tool while actively guiding at least some of the fluid passing the tool through the dedicated filter in the tool.*

*18. A method as claimed in claim 17 wherein the down-hole fluid moves in a relative upward direction in the first direction and a relative downward direction in the reverse direction.*

*19. A method as claimed in claim 17 wherein the down-hole fluid moves in a relative downward direction in the first direction and a relative upward direction in the reverse direction.*

*20. A method as claimed in claim 17 further including the process of trapping filtered debris upstream of the filter.*

*21. A down-hole tool for collecting debris particles in a well bore, the tool comprising:*

*a body connectable in a work string having an internal bore running axially therethrough which communicates with a circulation path in the work string;*

*a dedicated filter in the tool for filtering debris particles from at least some well fluid; and*

*diversion means for diverting said well fluid passing the tool through a flow path in the tool, distinct from the internal bore, which bypasses the filter when fluid flow is in a first direction relative to the tool and through the filter when fluid flow is in the reverse direction relative to the tool.*

* * * * *